United States Patent [19]

Uecker et al.

[11] Patent Number: 4,919,186

[45] Date of Patent: Apr. 24, 1990

[54] BLIND OPERATING DEVICE AND METHOD

[76] Inventors: William F. Uecker, 811 W. River Terr., McHenry, Ill. 60050; Earl M. Jahnke, 24 S. Pistakee Lake Rd., Fox Lake, Ill. 60020; Kenneth Hughes, 24946 - B Lake Shore Dr., Round Lake, Ill. 60078

[21] Appl. No.: 366,876

[22] Filed: May 24, 1989

[51] Int. Cl.[5] ..... E06B 9/20

[52] U.S. Cl. ..... 160/321; 160/84.1

[58] Field of Search ..... 160/171, 84.1, 178.1, 160/168.1, 176.1, 242–244, 321, 133

[56] References Cited

U.S. PATENT DOCUMENTS 2,103,398 12/1937 Wade et al. ..... 160/171
4,623,012 11/1986 Rude et al. ..... 160/243

FOREIGN PATENT DOCUMENTS 318989 12/1969 Sweden ..... 160/171

*Primary Examiner*—Blair M. Johnson
*Attorney, Agent, or Firm*—Mathew R. P. Perrone, Jr.

[57] ABSTRACT

A blind assembly has an endless roll cord and an endless pull cord to avoid the cord storage problem.

17 Claims, 4 Drawing Sheets

BLIND OPERATING DEVICE AND METHOD

BACKGROUND OF THE INVENTION

This invention relates to a method and device for raising and lowering blinds of the pleated type, roll-up type, or drapery-fabric Roman type, and more particularly to an endless roll-up mechanism for a blind of the pleated type, roll-up type, or drapery-fabric Roman type.

In blinds of the roll-up type, the pleated type or the drapery-fabric Roman type, it is difficult to precisely roll and unroll these blinds. For simplicity, reference to one member of the class of blinds includes all members of the class unless otherwise specified.

Blinds of the roll-up type generally have small slats strung together with a rolling type mechanism associated therewith. While bamboo is a common material used in blinds of the roll-up type, it is quite feasible to replace bamboo with wood or synthetic plastic slats of flat or tubular form. Roll-up is used herein as a standard definition of this type of blind. Basically, blinds of the roll-up type have a plurality of slats woven together, which can be rolled and unrolled.

A pleated blind, on the other hand, folds up along predetermined fold lines in fabric or other suitable material. The material used to form the pleated blind is stiffened in a known fashion to encourage folding along those predetermined lines.

The drapery-fabric Roman type blind incorporates a pull cord fixed to a bottom portion of the blind with the pull cord passing thorough a series of loops vertically secured to the fabric at spaced intervals. This structure causes the fabric to bend or fold between each pair of the loops as the blind is pulled up.

There is great difficulty involved in getting blinds to pull or roll-up evenly. Multiple pull or roll lines or cords (usually from two to six) pull or roll-up or let down these pleated or roll-up type blinds. Thus, the blinds are such that one side or the other can advance too much and roll or pull the one side higher than the other, creating a very uneven, non-aesthetic blind elevation.

When there are four (4) roll-up cords, as opposed to two roll-up cords, the problem is compounded. Each of the four cords can tangle or come off its respective rolling mechanism and throw the blind substantially off in its take up (roll-up) or let down. Thus, more roll-up cords provide more difficulty in a uniform rolling of the blind.

The device for rolling these blinds up and down is complex and difficult to operate because a great amount of cord is necessary to achieve the desired rolling up effect. For instance, an activating cord is provided which operates and coordinates the multiple roll cords. Thus, when the blind is rolled up, there is a substantial amount of activating cord exposed which is cumbersome to store.

When the blind is rolled up, the activating cord dangles to the floor, and becomes an unsightly nuisance as well as a danger to the safety of small children. In fact, the U.S. Consumer Product Safety Commission based in Washington, D.C., is the author of a Consumer Product Safety Alert regarding window blind or drapery cords, stating that a small child can be strangled by such exposed, dangling cord. The Commission recommends tying up or clamping the cord out of a child's reach.

This tying up or clamping is cumbersome and interferes with the rapid use and aesthetic appearance of the blind.

It has also proven difficult to provide a holding mechanism to maintain the position the rolling mechanism appropriately. By positioning the rolling mechanism appropriately, the desired blind roll-up level can be obtained while at the same time preventing unscheduled rolldowns of the blind.

Thus, many complicating structures are necessary to achieve the desired roll-up characteristics in a blind. If the structure to achieve the desired even roll-up can be simplified, great advantages are obtained.

SUMMARY OF THE INVENTION

Accordingly among the many objects of the present invention is to provide an improved mechanism for moving a pleated blind, a Roman blind, or a roll-up blind up or down.

It is a further object of this invention to provide an improved mechanism for rolling a blind up or down evenly.

A still further object of this invention is to provide an improved mechanism for rolling a blind with a reduced amount of roll cord.

Yet a further object of this invention is to provide an improved mechanism for locking the rolling mechanism of a blind in position.

Also an object of this invention is to provide an improved mechanism for rolling a blind having a minimized amount of activating cord.

Another an object of this invention is to provide an improved method for rolling a pleated blind or a roll-up blind up or down.

Yet another object of this invention is to provide an improved method for rolling a pleated blind or a roll-up blind up or down evenly.

Still another object of this invention is to provide an improved method for rolling a pleated blind or a roll-up blind with a reduced amount of roll cord.

A further object of this invention is to provide an improved method for locking a pleated blind or a roll-up blind in position.

A still further object of this invention is to provide an improved method for rolling a blind up or down with a minimized amount of activating cord.

Also an object of this invention is to provide an improved mechanism for rolling a blind having more than two roll-up cords.

These and other objects of the invention (which other objects become completely clear by consideration of the specification, claims and drawings as a whole) are met by providing an endless roll-up cord and an endless pull cord for the blind assembly.

BRIEF DESCRIPTION OF THE DRAWINGS

Throughout the Figures of drawings, where the same structure appears in more than one Figure of the drawing, the same reference number is applied thereto.

DESCRIPTION OF THE PREFERRED EMBODIMENTS

The blind assembly of this invention provides an even way to roll-up blinds. The roll-up mechanism for this blind assembly can include application to a pleated blind, a Roman blind, or roll-up type blind. Unless otherwise specified, a reference to blind includes these three types of blind. A centrally located reel in the blind housing accommodates an endless roll cord. Due to the centrally located reel, an uneven winding of the reel automatically compensates for, and receives the roll cord to provide for an even moving of the blind—such as rolling up or down. An endless, pull cord provides the control mechanism for the roll-up. This pull cord is a beaded cord that controls the blind and moves it up to uncover or down to cover. In this fashion, the problems of the long pull cord and long roll cord are avoided.

Figure 1:
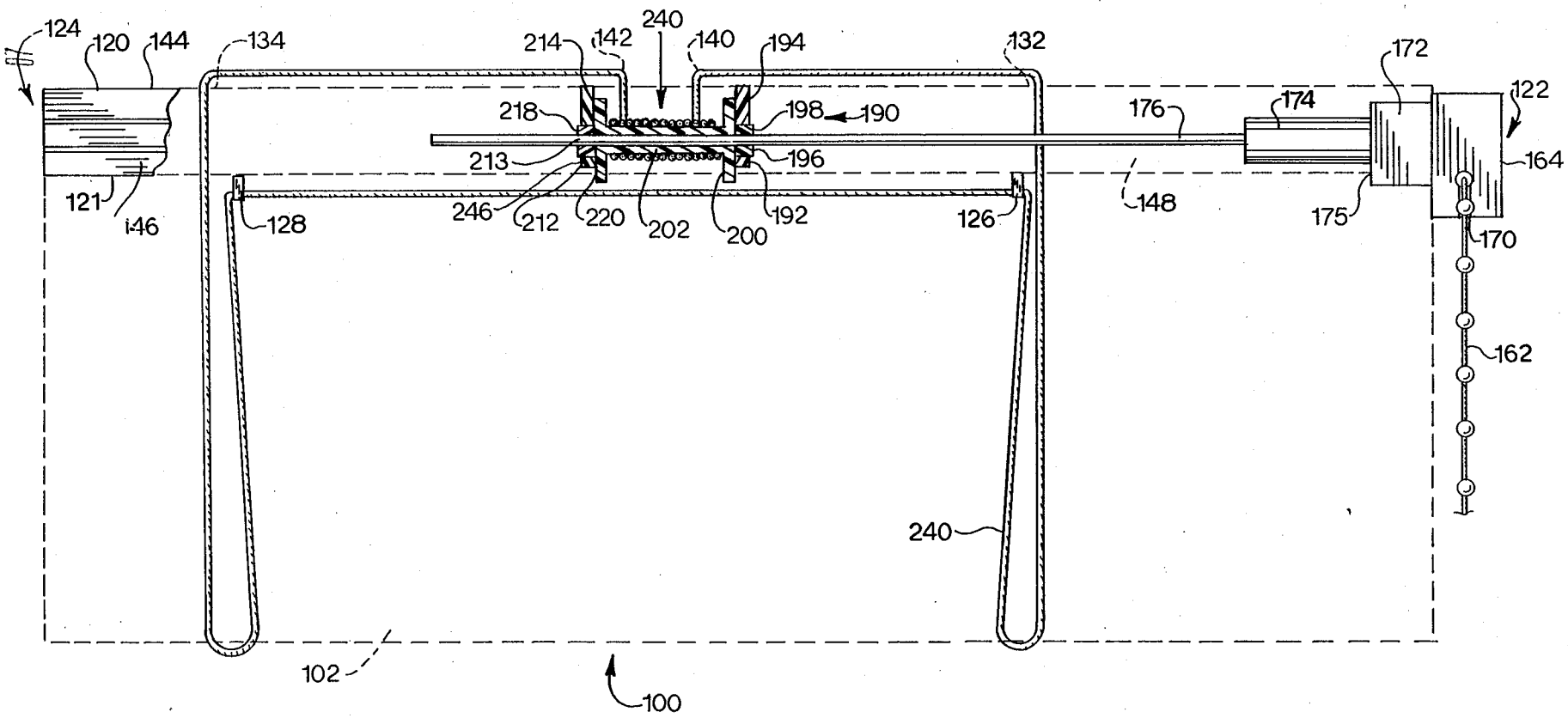
FIG. 1 depicts a front, partial cut away view of blind assembly 100.
Figure 2:
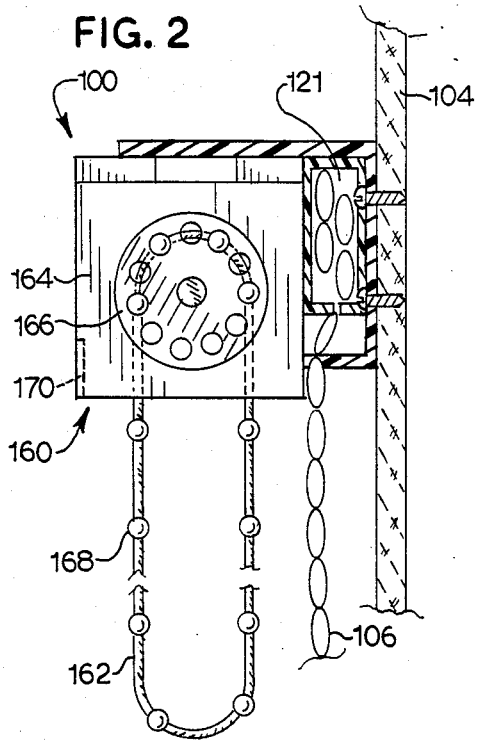
FIG. 2 depicts a end cut away view of a control end 122 of the blind assembly 100.
Figure 4:
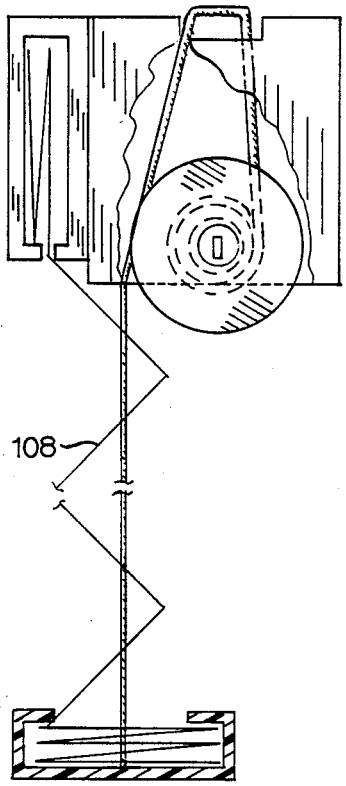
FIG. 4 depicts a pleated blind assembly viewed 108 from a idle end 124 thereof, and shows the pleated blind assembly 108 in a partially raised position.
Figure 6:
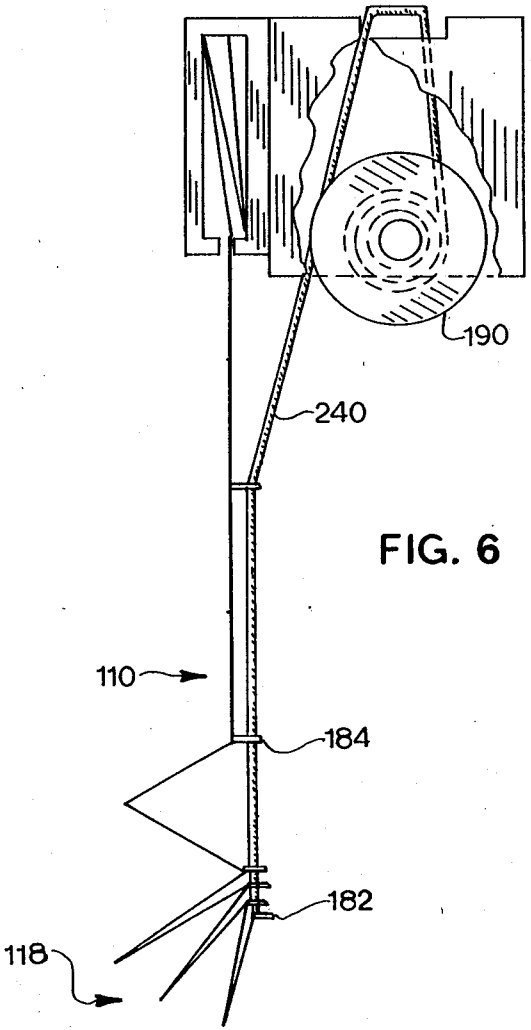
FIG. 6 depicts an end view of a drapery fabric, Roman type blind assembly 110 with the Roman assembly 110 being partially raised.

Referring now to FIG. 1, a blind assembly 100 is shown which includes a window covering 102. The window covering 102 of the blind assembly 100 is secured to a window frame 104 (shown in FIG. 2) to permit the blind assembly 100 to be mounted. The blind assembly 100 may be of the slatted or roll-up type 106 as shown in FIG. 2, of the pleated type 108 as shown in FIG. 4, or of the Roman type 110 as shown in FIG. 6.

All three types of blind assembly 100 (the roll-up type 106, the pleated type 108 and the Roman type 110) may use the same U-shaped frame 120 and the same clamp 121 to secure each type thereto or a different mechanism. Window covering 102 is secured by any suitable means (such as clamp 121) to U-shaped frame 120. Any other appropriate securing means can be used to replace clamp 121.

The U-shaped frame 120 is elongated and has a control end 122 forming one end thereof, and an idle end 124 forming the other end thereof and oppositely disposed therefrom. Positioned a predetermined distance from control end 122 is a first loop roller 126. First loop roller 126 is the same distance from control end 122 as second loop roller 128 is from idle end 124. First loop roller 126 and second loop roller 128 are secured to a bottom portion of U-shaped frame 120.

Situated between first loop roller 126 and control end 122 is first roll cord holder 132. Situated between second loop roller 128 and idle end 124 is second roll cord holder 134. These elements combine to provide part of the operations of blind assembly 100.

Situated between first loop roller 126 and second loop roller 128 is a first roller aperture 140 and a second roller aperture 142. The second roller aperture 142 is closer to idle end 124 than control end 122, as first roller aperture 140 is closer to control end 122 than to idle end 124. In fact, the distance between idle end 124 and second roller aperture 142 is the same as the distance between first roller aperture 140 and control end 122. By locating the structures in this fashion, an even roll-up or roll down of the blind assembly 100 is achieved as will be defined hereinafter.

A cross-section through the U-shaped frame 120 shows the same to be a generally square cross-section having one open side, with a base 144 of U-shaped frame 120 forming a top surface thereof. A forward side 146 of the U-shaped frame 120 extends substantially perpendicularly and downwardly from the base 144. A rear side 148 of U-shaped frame 120 is oppositely disposed from the forward side 146 and, when the assembly 100 is mounted, lies adjacent the window frame 104. The first loop roller 126 and second loop roller 128 are secured in standard fashion to rear side 148.

Second roller aperture 142 and first roller aperture 140 are formed in the base 144 of the U-shaped frame 120. The second roller aperture 142 is closer to second loop roller 128 than first loop roller 126. First roller aperture 140 is closer to first loop roller 126 than second loop roller 128.

Referring now to FIG. 2 and FIG. 4, a control apparatus 160 of the blind assembly 100 is secured to the control end 122 of frame 120. The control apparatus 160 is pictured as having a beaded end cord or pull cord 162 which feeds into a cord housing 164. The cord housing 164 contains a rotably mounted spiked cord reel 166 capable of meshing with the beads 168 on beaded pull cord 162.

A cord holder 170 is formed by providing a slot in cord housing 164 along forward side 146 of the U-shaped frame 120. Cord holder 170 is aligned outside spiked cord reel 166. In other words, spiked cord reel 166 is between cord holder 170 and gear housing 172.

Within the control apparatus 160 is a gear housing 172 and a second rod holder 174 as seen by reference to FIG. 1. Gear housing 172 is larger than second rod holder 174, while both combine to support rod 176. Rod 176 supports reel assembly 190 in a substantially central location within U-shaped frame 120.

The gear housing 172 accepts an end 175 of the rod holder 174 therein. The rod holder 174 is rotatably mounted within the gear housing 172 and is mechanically engaged therein by suitable means to the spiked cord reel 166. In other words, the rod holder 174 and cord reel 166 are engaged to each other within the gear housing 172 in a manner which provides the rotation of the rod holder 176 by the spiked cord reel 166 when the spiked cord reel 166 circles around the centerpoint. The circling of the cord reel 166 is produced when a user of the blind assembly 100 pulls on one or the other of the flights of the beaded pull cord 162.

Centrally located in U-shaped frame 120 is a reel assembly 190. Reel assembly 190 includes a first reel mount 192 and a second reel mount 212. The first reel mount 192 and the second reel mount 212 combine to hold reel 202 in position. The first reel mount 192 is secured to the base 144 at first secured end 194 while the second reel mount 212 is secured to the base 144 at second secured end 214.

Free ends of first reel mount 192 and second reel mount 212 each have a through bore 213 therein, which accomodates a portion of rod 176 therein in a rotatable manner. To provide such a rotatable mounting, the rod 176 is mounted within the throughbore 213 on a bearing. The first reel mount 192 has a first holding end 196 oppositely disposed from first secured end 194, while the second reel mount 212 has a second holding end 216 oppositely disposed from second secured end 214. First holding end 196 and second holding end 216 have through bores 213 with bearings therein. First bearing 198 is in first holding end 196 while second bearing 218 is in second holding end 216. The first bearing 198 and the second bearing 218 support rod 176 within first reel mount 192 and second reel mount 212.

Between first reel mount 192 and second reel mount 212 is a reel 202. Reel 202 includes first reel holder 200 and second reel holder 220. Second reel holder 220 is adjacent second bearing 218. First reel holder 200 is adjacent first bearing 198. Between first reel holder 200 and second reel holder 220, roll cord 240 is received. It is this rolling cord 240 that rolls up on reel 202 between first reel holder 200 and second reel holder 220.

The reel 202 provides a receiver for the rolling cord 240 with a first end 242 and a second end 244 (FIG. 5) secured to rod 176 which provides for the reel 202 to receive the rolling cord 240. In this fashion because of the positioning of the rolling cord 240, the blind assembly 100 can be rolled up evenlY whether it is roll-up blind 106 or pleated blind 108 or Roman blind 110.

In this respect, the reel 202 has the form of a spool which is mounted and operatively engaged to the rod 176, with the rod 176 acting as the pivot and rotational mechanism for the reel 202. The rolling cord 240 is, as shown, attached to the end edges 241 of the spool in a manner where the cord ends 242 and 244 are attached to the opposite end edges 241 of the reel 202, causing a crossing over of the ends 242 and 244 along the spooling face 245 of the reel or spool 202, as illustrated in FIG. 5.

Figure 3:
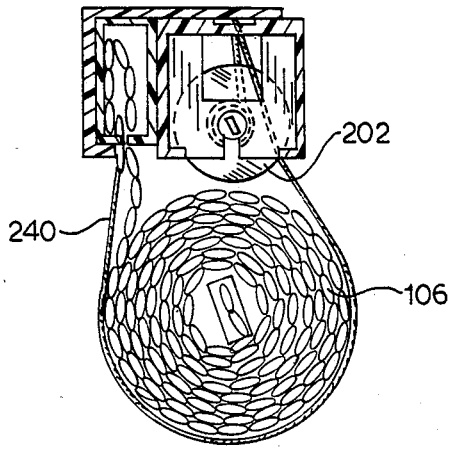
FIG. 3 depicts a slatted blind assembly viewed 106 from an idle end 124 thereof, the slatted blind assembly 106 being rolled up.

When considering FIG. 3, blind assembly 100 is shown with a roll-up blind 106 from idle end 124. The compactness of the blind assembly 100 simplifies the operation of the roll cord 240 as roll cord 240 is received around reel 202 between first reel holder 200 and second reel holder 220.

Figure 5:
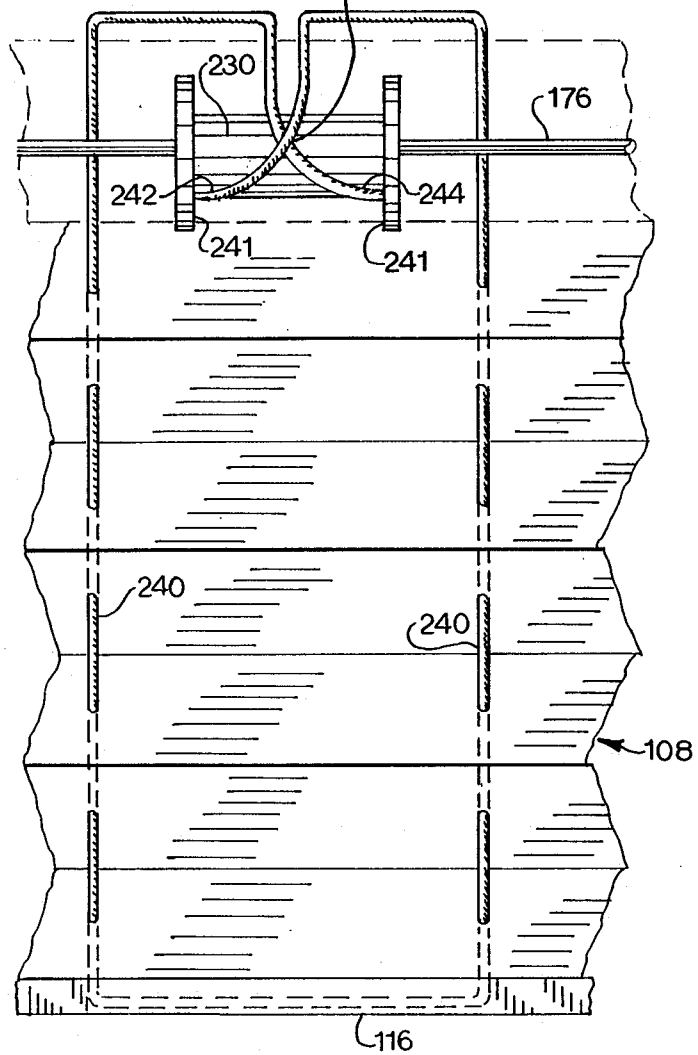
FIG. 5 depicts the pleated blind assembly 108 in partial cutaway to show the fold thereof.

Referring now to FIG. 5, the pleated blind 108 is shown as controlled with roll cord 240 fitted through a bottom pleat 116 of the pleated blind 108. Each end of roll cord 240 is attached to reel 230. Thus pleated blind 108 is raised or lowered in pleated fashion by the same mechanism as roll-up blind 106.

Turning to FIG. 6, the drapery fabric, Roman blind assembly 110 is shown as controlled with roll cord 240 running through a bottom section 118. Thus Roman blind assembly 110 is raised or lowered in accordian fashion by the same mechanism as roll-up blind assembly 106.

In FIG. 6, the Roman blind assembly 110 is shown in standard fashion. The roll cord 240 passes through a bottom loop 182 on bottom section 118 at the lower part of the Roman blind assembly 110. The roll cord 240 then passes thorugh a series of paired loops 184, which in turn feed the roll cord 240 upwardly to the reel assembly 190. As the endless pull cord 162 is moved, the roll cord 240 is collected on reel assembly 190 and pulls the bottom section 118 of the Roman blind assembly 110 upwardly, thereby forcing the Roman blind assembly 110 to fold up thereagainst in an accordian fashion.

Figure 7:
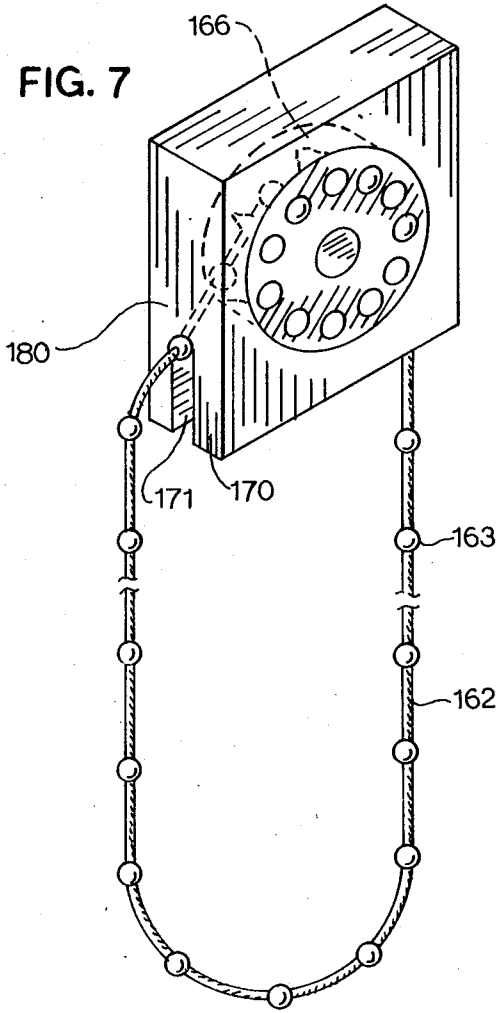
FIG. 7 depicts the control apparatus 160 in a locked position 180 thereof.

In FIG. 7, the cord holder 170 is shown in the locked position 180 thereof. With the pull cord 162 in locked position 180, the blind assembly 100 can roll neither up nor down. A simple tug on pull cord 162 unlocks the pull cord 162 from the locked position 180 thereof to allow blind assembly 100 to be repositioned with respect to covering window 102. The fact that the cord holder 170 is not aligned with spiked cord reel 166 provides for easy roll-up or roll down without the beaded cord of pull cord 162 getting locked in the locked position 180 inadvertantly.

In diameter, the beads 163 of the pull cord 162 are larger than the width of groove 171 of holder 170. When one desires to maintain the blind assembly 100 in a precise horizontal position, one activates the pull cord 162 until the desired elevation is reached, and then swings the pull cord 162 laterally to engage the beads 163 of the pull cord 162 within the groove 171.

Figure 8:
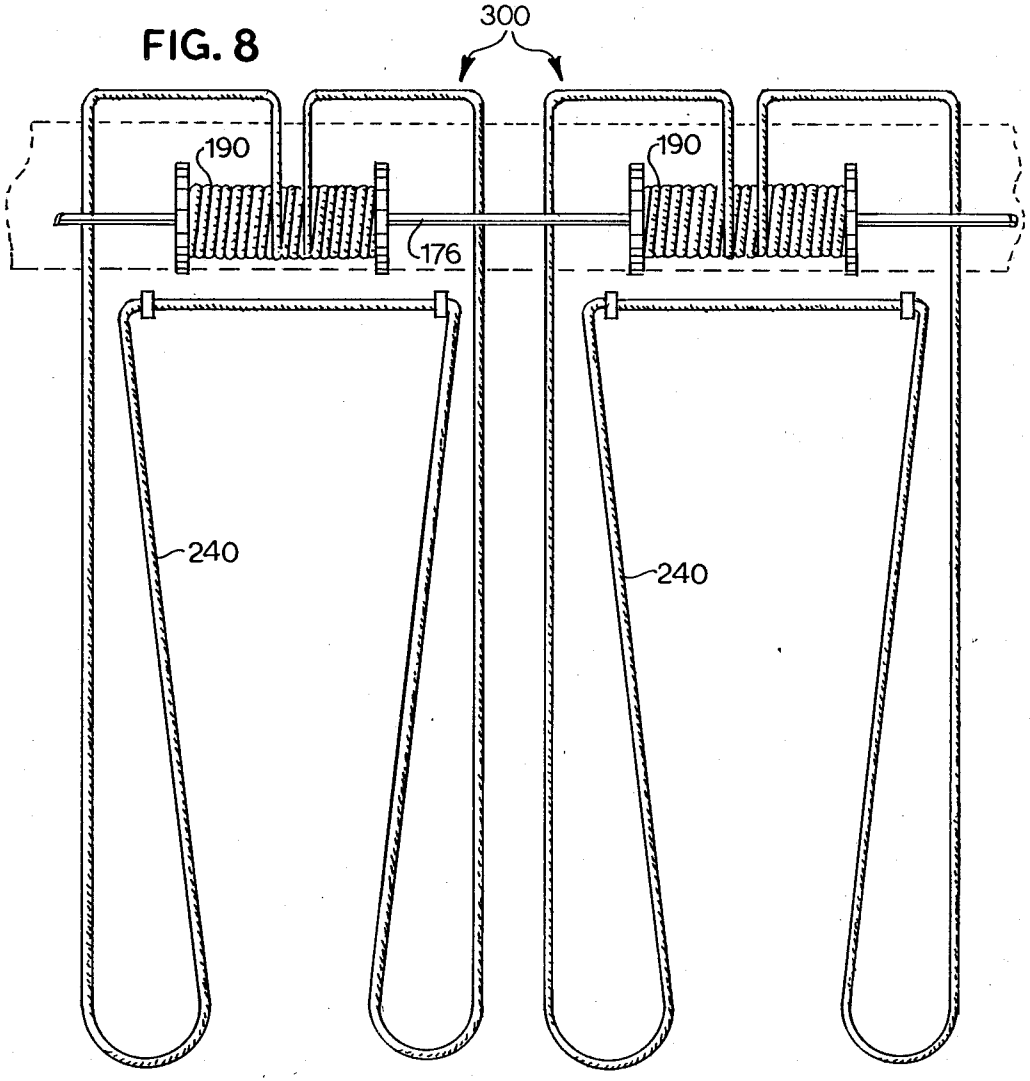
FIG. 8 depicts a front view of a double reel blind assembly 300 in partial cut away view.

FIG. 8 depicts a front partial cut away view of a double reel blind assembly 300. The double reel assembly 300 is substantially the same as the assembly 100 of FIG. 1, except for the fact that it includes two of reel assembly 190 mounted on the rod 176. With two of reel assembly 190, each serving a roll cord 240, a four cord blind 100 may be satisfied. Additionally, as many of reel assembly 190 as desired may be used to achieve the desired results. Thus, as long as the number of roll cords 240 is even, one of reel assembly 190 can be applied appropriately to each pair of roll cord 240. With the reel assemblies 190 fixed on the rod 176, it is quite possible to achieve even roll-up due to the fixed location of the reel assemblies 190 on the rod 176.

In the use of either of the slatted blind assembly 106, pleated blind asembly 108 and roman blind assembly 110 defined above, a user can hold one of the flights of the single circuitous pull cord 162 and pull down thereon, causing rotation of the spiked reel 166. The spiked reel 166, which in turn is connected to the mounted end 180 of the rod 176, causes rotation of same which in turn causes rotation of the reel 202 engaged thereon. Depending on which flight of the pull cord 162 is being pulled, the direction of rotation of the rod 176 and reel 202 is affected. Thus, pulling on one flight of the pull cord 162 causes an elevation of the blind assembly 100 while pulling on the other flight causes an opposite rotation, to result in lowering of the blind assembly 100.

This occurs because of the positioning of roll cord 240. A first end 242 of roll cord 240 is secured to reel 202. Roll cord 240 passes from reel 202 through second roller aperture 142 to the second roll cord holder 134 and then to the window covering 102. From the window covering 102 the roll cord 240 passes to first roll cord holder 132 and then to first roller aperture 140. At that time the second end 244 of roll cord 240 is secured to reel 202.

This application—taken as a whole with the specification, claims, and abstract,—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of the disclosure herein and solely because of the disclosure herein, certain modifications of the invention disclosed herein can become clear to a person having ordinary skill in this art. Such modifications are clearly covered hereby.

What is claimed and sought to be secured by Letters Patent of the United States, is:

1. A blind assembly including a blind frame and a window covering operably mounted in said blind frame wherein:

a. said blind frame has a top portion and a bottom portion;

b. a control assembly for operating said window covering is mounted at a control end of said blind frame;
c. an idle end of said blind frame is oppositely disposed from said control end of said blind frame;
d. said top portion and said bottom portion are between said idle end and said control end;
e. a reelable roll cord supports said window covering;
f. a reel assembly is mounted in said blind frame between said idle end and said contol end to receive said reelable roll cord and move said window covering;
g. said roll cord has a first roll cord end and a second roll cord end;
h. said roll cord is secured to said reel assembly at said first roll cord end and at said second roll cord end;
j. a first loop roller aperture and a second loop roller are secured to a bottom portion of said blind frame;
k. a first roll cord holder aperture and a second roll cord holder aperture are in a top portion of said blind frame;
l. a first roller aperture and a second roller aperture are situated between said first loop roller aperture and said second loop roller aperture in said top portion adjacent said reel assembly;
l. said second loop roller aperture is closer to said idle end than said control end;
m. said first loop roller aperture is closer to said control end than said idle end; and
n. said roll cord passes from said reel assembly at said first roll cord end, upwardly through said top portion at said first roller aperture toward said control end along a top of said frame, downwardly through said top portion at said first roll cord holder aperture to said window covering, upwardly from said window covering through said first loop roller aperture on said lower portion, toward said idle end through said second loop roller aperture on said lower portion, downwardly toward said window covering, upwardly through said top portion at said second roller holder aperture, along said top portion toward said control end, and downwardly through said top portion at said second roller aperture so that said second roll cord end is secured to said reel assembly.

2. The blind assembly of claim 1 wherein said window covering is a slatted roll up type.

3. The blind assembly of claim 1 wherein:
a. said control assembly includes an endless control cord feeding into a cord housing; and
b. said cord housing contains a control pulley to receive said endless cord.

4. The blind assembly of claim 3 wherein:
a. a cord holder is included in said cord housing;
b. said control pulley is rotatably mounted between said cord holder and a gear assembly;
c. said gear assembly is between said control pulley and said reel assembly.

5. The blind assembly of claim 2 wherein:
a. said reel assembly includes a first reel mount and a second reel mount, along with a take-up reel for said pull cord;
b. said first reel mount and said second reel mount combine to hold said take up reel; and
c. said first reel mount and said second reel mount are secured to said frame.

6. The blind assembly of claim 5 wherein:
a. said rod is bearing mounted in said first reel mount and said second reel mount; and
b. said take up reel is secured to said rod.

7. The blind assembly of claim 2 wherein said roll up cord is secured to said rod.

8. The blind assembly of claim 2 wherein said roll up cord is secured to an end edge of said reel assembly.

9. The blind assembly of claim 1 wherein:
a. said window covering is a pleated blind; and
b. said roll cord passes through a bottom pleat of said pleated blind.

10. The blind assembly of claim 1 wherein:
a. said window covering is a drapery blind;
b. said roll cord passes through a bottom portion of said drapery blind; and
c. said drapery blind has a series of loops secured thereto to assist said rollup cord.

11. The blind assembly of claim 2 wherein a double blind assembly is included having two reel assemblies.

12. The blind assembly of claim 1 wherein:
a. said window covering is a roll up blind;
b. said roll cord is secured at a first end of said roll cord to said reel assembly;
c. said roll cord passes from said reel assembly through said second roller aperture to a second roll cord holder aperture and then to said roll up blind; and
d. said roll cord passes from said roll up blind to said first roll cord holder and then to said first roller aperture at which point a second end of said roll cord is secured to said reel.

13. The blind assembly of claim 1 wherein:
a. an endless operating cord operates a control assembly for said blind assembly;
b. said control assembly includes an endless control cord feeding into a cord housing;
c. said cord housing contains a control pulley to receive said endless cord;
d. a cord holder is included in said cord housing;
e. said control pulley is rotatably mounted between said cord holder and a gear assembly;
f. said gear assembly is between said control pulley and said reel assembly;
g. said control pulley is a spiked pulley;
h. said endless control cord has a series of beads equally spaced thereon throughout the length thereof;
i. said beads mesh with said spiked pulley to cause said spiked pulley to rotate when said endless control cord is operated;
i. said control pulley is secured to said rod and causes rotation of said rod as said control pulley rotates;
j. said reel assembly includes said rod; and
k. said reel assembly accepts said pull cord upon rotation.

14. The blind assembly of claim 13 wherein:
a. said reel assembly includes a first reel mount and a second reel mount, along with a take-up reel for said pull cord;
b. said first reel mount and said second reel mount combine to hold said said take up reel;
c. said first reel mount and said second reel mount a secured to said frame;
d. said rod is bearing mounted in said first reel mount and said second reel mount; and
e. said take up reel is secured to said rod.

15. The blind assembly of claim 14 wherein:
a. said window covering is a pleated blind; and b. said roll cord passes through a bottom pleat of said pleated blind.

16. The blind assembly of claim 14 wherein:

a. said window covering is a drapery blind;

b. said roll cord passes through a bottom portion of said drapery blind; and c. said drapery blind has a series of loops secured thereto to assist said rollup cord.

17. The blind assembly of claim 1 wherein:

a. said window covering is a roll up blind;

b. said roll cord is secured at a first end of said roll cord to said reel assembly;

c. said roll cord passes from said reel assembly through said second roller aperture to said second roll cord holder aperture and then to said roll up blind; and d. said roll cord passes from said roll up blind to said first roll cord holder aperture and then to said first roller aperture at which point a second end of said roll cord is secured to said reel.

* * * * *